US011085585B2

(12) United States Patent
Trimble et al.

(10) Patent No.: US 11,085,585 B2
(45) Date of Patent: Aug. 10, 2021

(54) FILL STATION

(71) Applicant: Pressure Specialist, Inc., Crystal Lake, IL (US)

(72) Inventors: Raymond Trimble, Marengo, IL (US); Scot W. Tillman, Crystal Lake, IL (US); Aaron A. Stephens, Bartlett, IL (US)

(73) Assignee: Pressure Specialist, Inc., Crystal Lake, IL (US)

( * ) Notice: Subject to any disclaimer, the term of this patent is extended or adjusted under 35 U.S.C. 154(b) by 176 days.

(21) Appl. No.: 16/660,384

(22) Filed: Oct. 22, 2019

(65) Prior Publication Data

US 2020/0132255 A1 Apr. 30, 2020

Related U.S. Application Data

(60) Provisional application No. 62/752,662, filed on Oct. 30, 2018.

(51) Int. Cl.
*F17C 5/06* (2006.01)

(52) U.S. Cl.
CPC ..... *F17C 5/06* (2013.01); *F17C 2205/0323* (2013.01); *F17C 2221/031* (2013.01)

(58) Field of Classification Search
CPC ..... F17C 5/06; F17C 2221/031; F17C 2205/0323
USPC ..... 137/168, 247.27, 565.26, 597
See application file for complete search history.

(56) References Cited

U.S. PATENT DOCUMENTS

| | | | |
|---|---|---|---|
| 473,069 | A | 4/1892 | Giessenbier |
| 509,923 | A | 12/1893 | Locke |
| 1,183,920 | A | 5/1916 | Wallace |
| 2,438,231 | A | 3/1948 | Schultz |
| 2,615,287 | A | 10/1952 | Senesky |
| 2,717,096 | A | 9/1955 | Henderson |
| 2,918,081 | A | 12/1959 | Lauer, Jr. |

(Continued)

FOREIGN PATENT DOCUMENTS

EP 0382711 A2 8/1990

*Primary Examiner* — Timothy L Maust
(74) *Attorney, Agent, or Firm* — Levenfeld Pearlstein, LLC

(57) ABSTRACT

A fill station permits transferring a gas, such as a compressed gas from a second device to a first device. The fill station includes a body having an inlet, an inlet/outlet port and an outlet. The body has a passage extending between the inlet, the inlet/outlet port and the outlet. The passage includes a central passage portion. The body includes a bore therein in communication with the central passage portion. A valve assembly includes a seal, a seat, a ball and a biasing member mounted in the body at a first side of the central passage in communication with the inlet/outlet port and a seal, a seal support, and an actuator shaft positioned in the body on an opposite side of the central passage portion. Engagement of the actuator shaft with the ball moves the ball off of the seat to open flow communication from the inlet/outlet port to the outlet and disengagement of the actuator shaft from the ball moves the ball onto the seat to close flow communication from the inlet to the outlet. When the ball is on the seat to close flow communication from the inlet/outlet port to the outlet, flow is communicated from the inlet to the inlet/outlet port.

6 Claims, 3 Drawing Sheets

(56) References Cited

U.S. PATENT DOCUMENTS 3,147,767 A * 9/1964 Goss ..... B60S 3/044 137/879
3,347,109 A 10/1967 Adams et al.
3,360,004 A 12/1967 Lewis et al.
3,474,822 A 10/1969 Kuhn
3,538,930 A 11/1970 Kowalski
3,602,250 A 8/1971 Neenan
3,791,412 A * 2/1974 Mays ..... F16K 17/0486 137/614.11
3,795,255 A * 3/1974 Malott ..... F15B 11/02 137/102
3,848,631 A 11/1974 Fallon
3,890,999 A 6/1975 Moskow
3,926,208 A 12/1975 Hoffman
3,961,721 A 6/1976 Gordon
3,995,656 A 12/1976 Mills, Jr.
4,064,890 A 12/1977 Collins et al.
4,064,910 A * 12/1977 Weisenberger ..... F16F 15/027 137/627.5
4,168,129 A 9/1979 Herrnring
4,181,139 A 1/1980 Martini
4,194,522 A 3/1980 Lucas et al.
4,226,257 A 10/1980 Trinkwalder
4,305,423 A 12/1981 Adler
4,450,858 A 5/1984 Acomb
4,484,695 A 11/1984 Fallon et al.
4,648,431 A * 3/1987 Strongert ..... F17C 5/06 137/596.2
4,785,847 A 11/1988 Steer et al.
4,791,957 A 12/1988 Ross
5,036,878 A 8/1991 Fournillon et al.
5,086,807 A 2/1992 Lasnier et al.
5,123,442 A 6/1992 Geuy et al.
5,135,023 A 8/1992 Ross
5,234,026 A 8/1993 Patterson
5,280,778 A 1/1994 Kotsiopoulos
5,348,037 A 9/1994 Katchka
5,368,022 A 11/1994 Wagner
5,392,825 A 2/1995 Mims et al.
5,411,053 A 5/1995 Holt
5,497,803 A 3/1996 Ferrante
5,507,308 A 4/1996 Chambonnet
5,516,157 A 5/1996 Williamson
5,522,421 A 6/1996 Holt
5,669,369 A 9/1997 Scott
5,996,625 A * 12/1999 Collado ..... G05D 16/101 137/614.19
6,056,006 A 5/2000 Hagerty
6,170,519 B1 * 1/2001 Carroll ..... G05D 16/107 137/505.42
6,186,168 B1 2/2001 Schultz et al.
6,321,779 B1 11/2001 Miller et al.
6,363,964 B1 4/2002 Carroll
6,554,322 B2 4/2003 Duong et al.
6,672,332 B2 1/2004 Carroll
6,851,447 B1 2/2005 Carroll
6,948,520 B2 9/2005 Carroll
7,051,751 B2 5/2006 Carroll
7,419,189 B2 9/2008 Dickerson et al.
7,490,622 B2 2/2009 Jones
7,610,937 B1 11/2009 Trimble et al.
8,991,423 B2 * 3/2015 Matsukawa ..... F02D 19/0681 137/606
2008/0295899 A1 12/2008 Jones
2010/0175763 A1 7/2010 Newman

* cited by examiner

FILL STATION

CROSS-REFERENCE TO RELATED APPLICATION DATA

This application claims the benefit of and priority to Provisional U.S. Patent Application Ser. No. 62/752,662, filed Oct. 30, 2018, titled "FILL STATION," the disclosure of which is incorporated herein in its entirety.

BACKGROUND

The present disclosure is directed to a fill station. The fill station is used to transfer a pressurized gas from a pressurized gas source, such as a bulk storage container to another device, such as a gas storage bottle. In one use, the fill station is used to transfer a pressurized gas from a gas source to a local bottle, in any air-driven or pneumatic system. A contemplated use is for transferring a pressure gas from a storage tank to a local tank for use with a paintball gun.

SUMMARY

A fill station permits transferring a gas from a second device to a first device. The fill station can be used to transfer a gas, such as compressed air from a cylinder carried by a paintball player to player's paintball gun. The fill station can also be used to permit refilling the cylinder with compressed air from a bulk storage tank.

The fill station includes a body having an inlet for communicating compressed air form the bulk storage tank to the cylinder, an inlet/outlet port to allow flow from the bulk storage tank to the cylinder and from the cylinder to the paintball gun and an outlet to communicate compressed air from the cylinder to the paintball gun.

The body has a passage extending between the inlet, the inlet/outlet port and the outlet. The passage includes a central passage portion. The body further includes a bore therein in communication with the central passage portion.

A valve assembly includes a seal, a seat, a ball and a biasing member mounted in the body at a first side of the central passage in communication with the inlet/outlet port, and a seal, a seal support, and an actuator shaft positioned in the body on an opposite side of the central passage portion, Engagement of the actuator shaft with the ball moves the ball off of the seat to open flow communication from the inlet/outlet port to the outlet and disengagement of the actuator shaft from the ball moves the ball onto the seat to close flow communication from the inlet to the outlet. When the ball is on the seat to close flow communication from the inlet/outlet port to the outlet, flow is communicated from the inlet to the inlet/outlet port.

In an embodiment, the fill station can include a knob for rotating the actuator shaft to move the actuator shaft into and out of engagement with the ball. The spring urges the ball into engagement with the seat. A fill nipple is disposed at the inlet and is configured to permit the flow of gas from the inlet to the central passage.

The fill station is further configured to accommodate a third device, such as the paintball gun. The fill station permits transferring a gas either from the cylinder to the paintball gun or permits transferring a gas from the bulk storage tank to the cylinder. When the gas is transferred from the bulk storage tank to the cylinder, the paintball gun is isolated and when the gas is transferred from the bulk cylinder to the paintball gun, the bulk storage tank is isolated.

DESCRIPTION OF THE DRAWINGS

The benefits and advantages of the present invention will become more readily apparent to those of ordinary skill in the relevant art after reviewing the following detailed description and accompanying drawings, wherein.

DESCRIPTION

Figure 1:
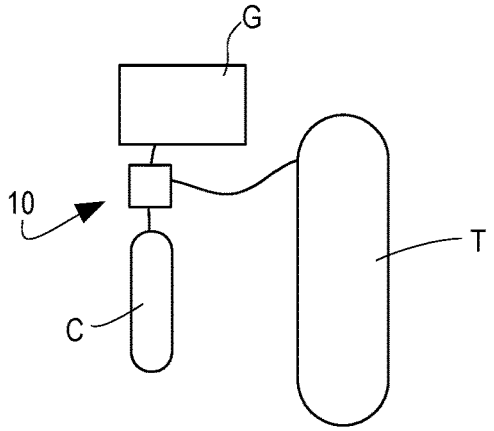
FIG. 1 is schematic illustration of an embodiment of a fill station with a device to which a pressurized gas is to be supplied, such as a paintball gun, a local bottle or cylinder and a bulk source of pressurized gas.

While the present disclosure is susceptible of embodiment in various forms, there is shown in the drawings and will hereinafter be described a presently preferred embodiment with the understanding that the present disclosure is to be considered an exemplification of the device and is not intended to limit the claims to the specific embodiment illustrated.

Referring to FIG. 1, a present fill station 10 is shown. The station 10 is positioned between a bulk storage tank T and a local bottle, referred to as a cylinder C. The station is used to supply a compressed gas, such as compressed air from the cylinder C to a device that operates on compressed air, such as a paintball gun G. The station can be used to supply compressed air from the cylinder to the paintball gun and to fill the cylinder from the bulk storage tank T, and can permit filling the cylinder from the bulk storage tank T without disconnecting the fill station 10 from the paintball gun.

The station 10 includes a body 12 having a port 14 that serves as both an inlet and an outlet (referred to as the I/O port) 14 and an outlet 16. The I/O port 14 includes an I/O bore 20. The outlet 16 is in communication with, for example, an outlet hose 22 having quick disconnect fitting 24. Referring now to FIGS. 2A and 2B, an air passage 26 extends through the body from the I/O port 14 to the outlet 16. A central passage portion 28 communicates the air passage between the I/O port 14 and the outlet 16. A fill bore or fill port 30, a gauge bore 32 and a burst disk bore 34 in the body 12 include passages that extend into the I/O bore 20. An outlet bore 36 and bore 38 to, for example, accommodate a gauge 40, extend into the central passage 36.

A valve assembly 42 is positioned on both sides of the central passage 28. An inlet side 44 of the valve assembly 42 includes an flange insert 46, spring 48, ball 50, seat 52 and seal 54, such as the illustrated O-ring. The ball 50 engages the seat 52 to seal or close the valve assembly 42. Although not shown, a pin can be used in place of the ball 50 to engage (seat on) the seat 52 to close the valve assembly 42. The flange insert 46 includes a first end 56 that threads into the bulk storage tank T and a second end 58 that threads into the body 12 at the I/O port 14. The spring 48 resides in the second end 58 of the flange insert 46. Various seals, such as O-rings 60, are used to seal the threaded fittings as needed.

On an opposite side of the central passage 28 the station 10 includes an outlet side 62 of the valve assembly 42, which includes a seal 64 such as an O-ring, a seal jam nut 66 to hold the seal 64 in place in the body 12, a spring 68 and an actuator shaft 70. The valve assembly outlet side 62 resides in an valve bore 71. The station 10 includes a housing nut 72, actuator screw 74, actuator nut 76, and a knob 78. The housing nut 72 and actuator nut 76 retain the actuator screw 74 and actuator shaft 70 in place and threaded into the body 12. As such, the housing nut 72 and actuator nut 76 are stationary when the station 10 is in use as they retain the moving elements (the actuator screw 74, actuator shaft 70, and spring 68) in place in the body 12.

The outlet hose 22 is connected to the body 12 at the outlet bore 36, a gauge 40 is mounted to the body 12 at the gauge bore 38 and a fill nipple assembly 82 is mounted to the fill bore 30. A burst disk assembly 80, such as that disclosed in Carroll, U.S. Pat. No. 7,051,751, which patent is commonly assigned with the present application, is mounted to the body 12 at the burst disk bore 34. The quick connect fitting 24 can be mounted to the outlet side of the transfer hose 22.

The fill station 10 can be used in a number of different ways. In one use, the fill station 10 can be used to transfer the pressurized gas from the cylinder C that may be carried by a user for example in use with a paintball gun G, to the paintball gun. In another use, the fill station 10 is used to transfer a pressurized gas from one storage container, for example, a bulk storage tank T to a second storage container, such as the cylinder C. For example, the fill station can be used to transfer a pressurized gas from the bulk source T to the cylinder C.

In the first use, to transfer pressurized gas from the cylinder C to, for example, the paintball gun G, the fill station is mounted between the cylinder C and the paintball gun G. The cylinder C is threaded into the fill station 10 at the I/O port 14 and the paintball gun G is connected to the station via the outlet or transfer hose 22 which is mounted to the station 10 at the outlet bore or port 36. When the valve is closed (the ball 50 is seated on the seat 52), the pressurized gas is isolated from the cylinder C by the closed valve.

To fill the cylinder C, the knob 78 is rotated which in turn rotates the actuator screw 74, which in turn moves the actuator shaft 70 into contact with the ball 50. As the ball 50 is moved off of the seat 52, it opens flow communication from the cylinder C to the paintball gun G via air passage 26. In that the gas pressure is not regulated, the paintball gun G will be pressurized to the same pressure as the cylinder C pressure. It will be appreciated that the transfer of gas from the cylinder C to the paintball gun G can be stopped at any time by rotating the knob 78 to draw the actuator shaft 70 away from the ball 50, which allows the ball 50 to engage (seat on) the seat 52 and close the valve. The fill nipple 82 (which functions as a one-way valve) prevents the flow of pressurized gas from the body 12 out through the fill nipple 82.

Figure 5:
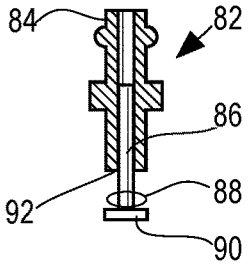
FIG. 5 illustrates a fill nipple.

Referring to FIG. 5, the fill nipple 82 is a one-way valve that allows flow into body 12, but prevents backflow through the fill nipple 82. The fill nipple 82 includes a fill nipple body 84, fill nipple strut 86 and a seal 88, such as an O-ring. The seal 88 is positioned on the strut 86 against a head 90 of the strut 86, and the strut 86 is positioned in the nipple body 84. The seal 88 is captured on and engages a shoulder 92 in the nipple body 84 when the inlet side of the station is pressurized. When a higher pressure (supply) is connected to the fill nipple body 84, the pressure moves the strut head 90 off of the shoulder 92 to allow gas to flow into the fill station body and out of the body through the I/O port into, for example, the cylinder. When there is no pressure on the fill nipple 82 (in the fill direction of flow), pressure on the strut 86 and the seal 88 prevent flow out of the fill nipple 82.

In the second use, the fill station 10 is used to transfer pressurized gas from the from one storage container to a second storage container, for example, to transfer a pressurized gas from a bulk source T to the cylinder C. The fill station 10 can remain mounted to the cylinder C at the I/O port 14 and the bulk tank T is connected to cylinder C at the fill nipple 82 in the fill port 30.

Pressurized gas flows into and through the body 12 and out into the cylinder C through the I/O port 14. Pressure in the cylinder C will match the supply pressure from the bulk storage tank T. Because the fill bore 30 is located upstream of the valve seat 52 (upstream during normal operations), the pressure from the bulk tank T is exerted on the ball 50 which remains on the seat 52 to maintain the fill station valve 42 closed to isolate the cylinder C from the paintball gun G and prevent flow into paintball gun G mounted to the station 10. The cylinder C will fill until the pressure between the bulk tank T and the cylinder C are at equilibrium. That is, the cylinder C will be filled to the same pressure as the bulk tank T.

Once the cylinder C is filled, the connection between the fill station 10 and the bulk tank T can be removed and the fill nipple 82 (again a one-way valve) will prevent flow out of the cylinder C through the fill nipple 82. The paintball gun G also remains isolated since the valve 42 is closed.

Figure 2:
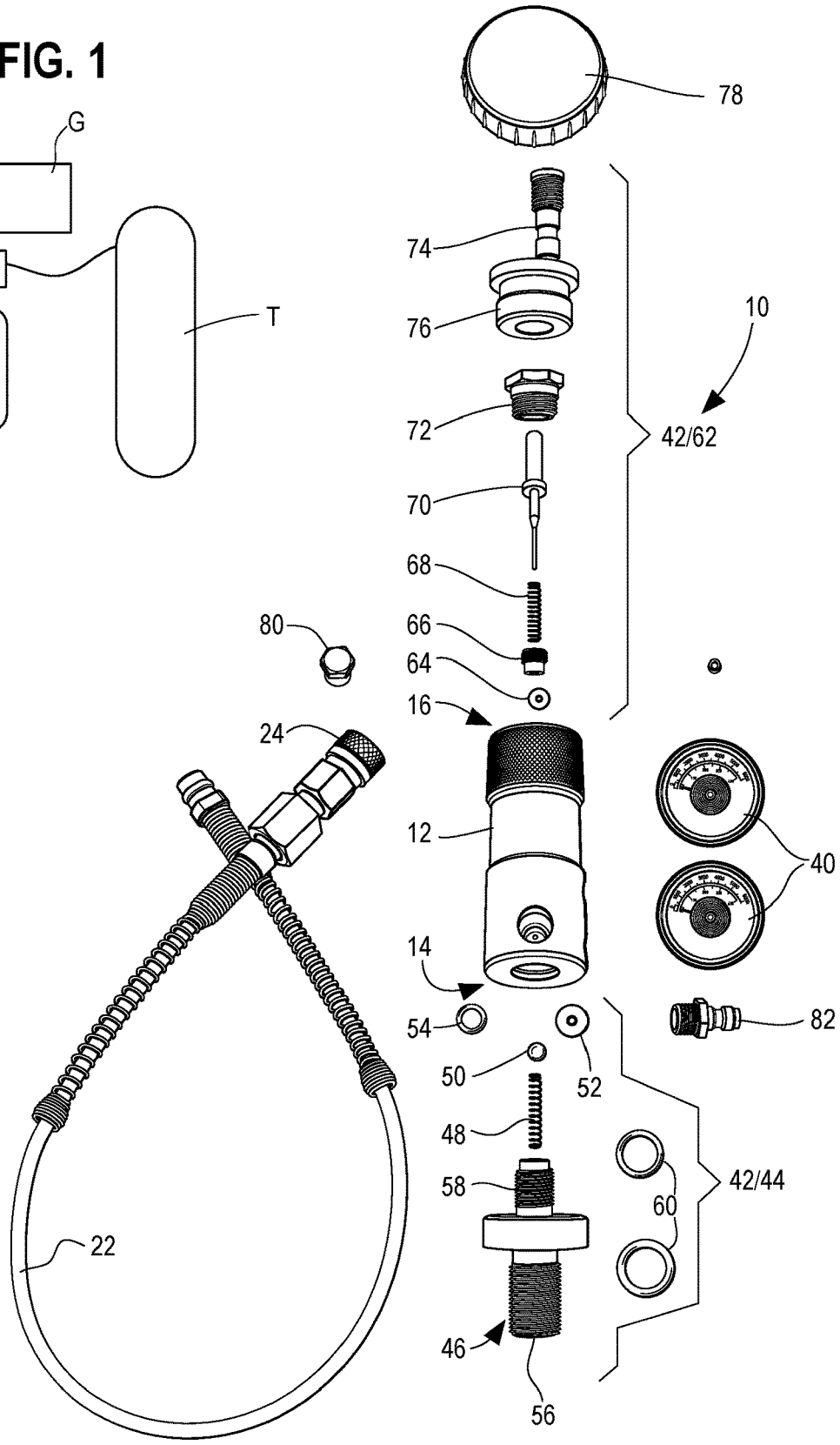
FIG. 2 is an exploded view of an embodiment of a fill station.
Figure 3A:
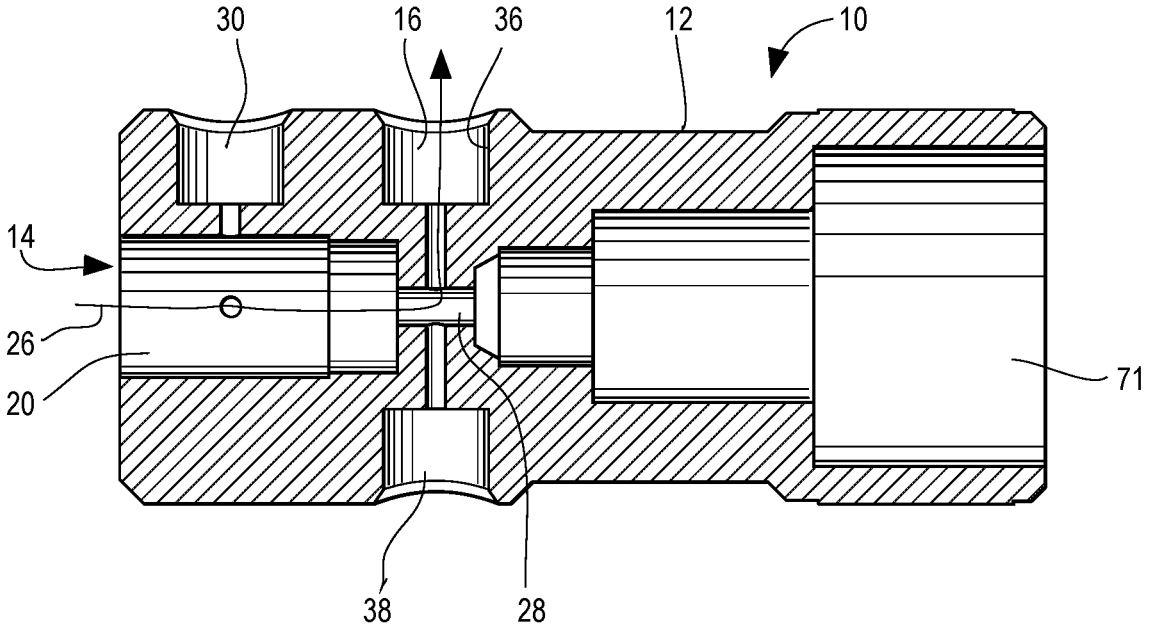
FIGS. 3A and 3B are sectional illustrations of an embodiment of a fill station body.
Figure 3B:
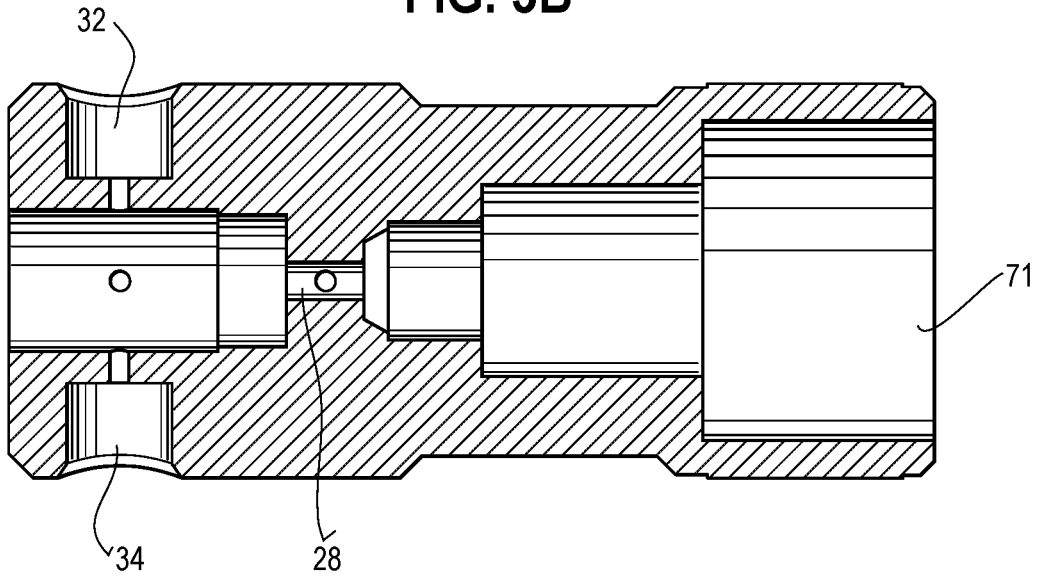
Figure 4A:
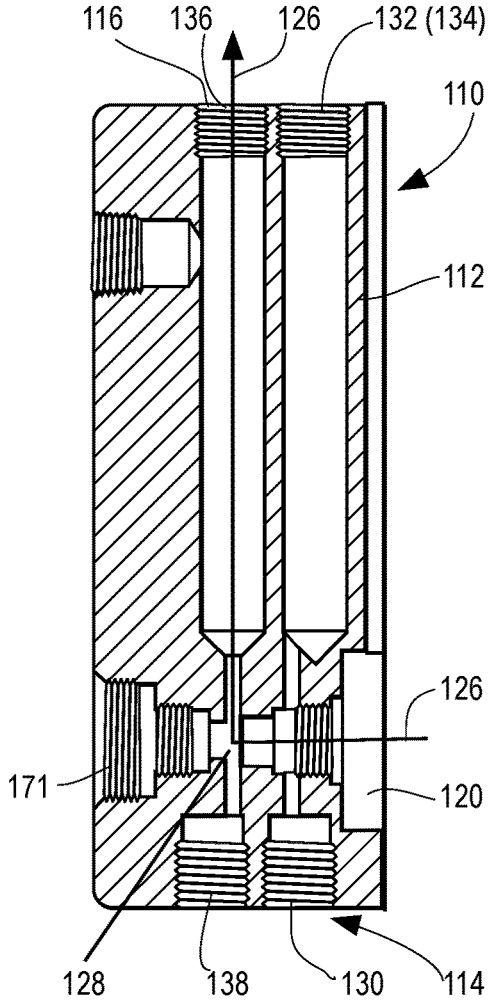
FIG. 4A-4C are sectional (FIGS. 4A and 4B) and a plan view of an embodiment of a fill station.
Figure 4B:
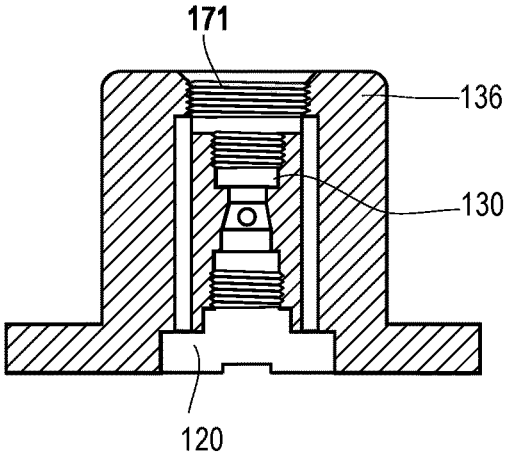
Figure 4C:
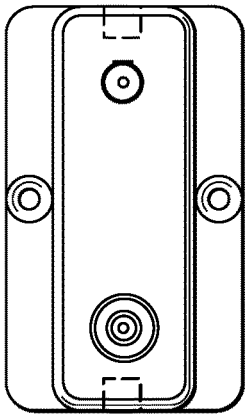

A body 112 of another embodiment of the fill station 110 is illustrated in FIGS. 4A-4C. The valve assembly, gauges and ports or bores can be the same as or correspond to those of the embodiment in FIGS. 2-3, as can the mode of operation. In this embodiment reference numbers in the 100 series in FIGS. 4A and 4B are used to indicate corresponding features to those of the embodiment in FIGS. 2 and 3. The station 110 includes a body 112 having a port 114 that serves as both an inlet and an outlet (referred to as the I/O port) 114 and an outlet 116. The I/O port 114 includes an I/O bore 120. The outlet 116 is in communication with, for example, an outlet hose (not shown) having quick disconnect fitting. Referring now to FIGS. 2A and 2B, an air passage 126 extends through the body from the I/O port 114 to the outlet 116. A central passage portion 128 communicates the air passage between the I/O port 114 and the outlet 116. A fill bore or fill port 130, a gauge bore 132 and a burst disk bore 134 in the body 112 include passages that extend into the I/O bore 120. An outlet bore 136 and bore 138 to, for example, accommodate a gauge (not shown), extend into the central passage 136. The valve assembly outlet side resides in a valve bore 171.

As noted above, a pin can be used in place of a ball. It is also contemplated that a push-type configuration can be used in place of the threaded actuator screw. That is, rather than rotating a knob and actuator screw, a push-to-open configuration may be used to move the actuator shaft into engagement with the ball (or pin) to open the valve.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A fill station for transferring a gas from a first device to a second device, comprising:

a body having an inlet, an inlet/outlet port and an outlet, the body having a passage extending between the inlet, the inlet/outlet port and the outlet, the passage including a central passage portion, the body further including a bore therein in communication with the central passage portion, a valve assembly including a seal, a seat, a ball and a biasing member mounted in the body at a first side of the central passage in communication with the inlet/outlet port and a seal, a seal support, and an actuator shaft positioned in the body on an opposite side of the central passage portion, wherein engagement of the actuator shaft with the ball moves the ball off of the seat to open flow communication from the inlet/outlet port to the outlet and disengagement of the actuator shaft from the ball moves the ball onto the seat to close flow communication from the inlet to the outlet, and wherein when the ball is on the seat to close flow communication from the inlet/outlet port to the outlet, flow is communicated from the inlet to the inlet/outlet port.

2. The fill station of claim 1, wherein the valve assembly further includes a knob for rotating the actuator shaft to move the actuator shaft into and out of engagement with the ball.

3. The fill station of claim 1, wherein the spring urges the ball into engagement with the seat.

4. The fill station of claim 1, including a fill nipple disposed at the inlet, the fill nipple configured to permit the flow of gas from the inlet to the central passage.

5. The fill station of claim 1, wherein said fill station is further configured to accommodate a third device, and wherein the fill station permits transferring a gas either from the second device to the first device or permits transferring a gas from the third device to the second device.

6. The fill station of claim 5, wherein when the gas is transferred from the second device to the first device, the third device is isolated and when the gas is transferred from the third device to the second device, the first device is isolated.

* * * * *